US006606890B1

(12) United States Patent
Widen

(10) Patent No.: US 6,606,890 B1
(45) Date of Patent: Aug. 19, 2003

(54) REMOVABLE CORE CYLINDER LOCK

(75) Inventor: Bo Widen, Torshalla (SE)

(73) Assignee: Winloc AG, Zug (CH)

( * ) Notice: Subject to any disclaimer, the term of this patent is extended or adjusted under 35 U.S.C. 154(b) by 0 days.

(21) Appl. No.: 09/889,779

(22) PCT Filed: Jan. 21, 2000

(86) PCT No.: PCT/SE00/00130

§ 371 (c)(1),
(2), (4) Date: Jul. 20, 2001

(87) PCT Pub. No.: WO00/43618

PCT Pub. Date: Jul. 27, 2000

(51) Int. Cl.[7] ..... E05B 9/04

(52) U.S. Cl. ..... 70/369; 70/370; 70/371; 70/451

(58) Field of Search ..... 70/367–371, 373, 70/451, DIG. 60

(56) References Cited

U.S. PATENT DOCUMENTS

| | | | | | |
|---|---|---|---|---|---|
| 1,207,465 | A | * | 12/1916 | Augenbraun | |
| 1,335,821 | A | * | 4/1920 | Crane | |
| 1,407,472 | A | * | 2/1922 | Maxwell | |
| 1,480,650 | A | * | 1/1924 | Bacon | |
| 1,501,315 | A | * | 7/1924 | Dement | |
| 1,518,996 | A | * | 12/1924 | Maunder | |
| 2,059,678 | A | | 11/1936 | Briggs | 70/46 |
| 2,469,806 | A | * | 5/1949 | Zion | |
| 3,404,549 | A | | 10/1968 | Best | 70/370 |
| 3,667,264 | A | | 6/1972 | Surko, Jr. et al. | 70/369 |
| 4,328,690 | A | | 5/1982 | Oliver | 70/369 |
| 4,424,693 | A | | 1/1984 | Best et al. | 70/369 |
| 4,444,034 | A | | 4/1984 | Best et al. | 70/369 |
| 5,678,438 | A | | 10/1997 | Kolkman et al. | 70/370 |
| 5,813,260 | A | | 9/1998 | Widen | 70/369 |

FOREIGN PATENT DOCUMENTS

| | | | | |
|---|---|---|---|---|
| DE | 484981 | * | 10/1929 | 70/370 |
| DE | 626956 | * | 3/1936 | 70/370 |
| DE | A2723887 | | 12/1978 | |
| DK | 67305 | * | 7/1948 | 70/370 |
| EP | A20473288 | | 3/1992 | |
| GB | A2216944 | | 10/1989 | |
| WO | WO 96/36782 | | 11/1996 | |

* cited by examiner

*Primary Examiner*—Lloyd A. Gall
(74) *Attorney, Agent, or Firm*—Birch, Stewart, Kolasch & Birch, LLP

(57) ABSTRACT

A removable core cylinder lock, comprising a casing, a lock core with a rotatable key plug in a cylindrical bore and a retainer adapted to releasably retain the lock core in an inserted position in the casing. The casing has two lugs extending radially inwards and being separated transversely from each other, whereas the lock core has two corresponding recesses on both sides of a central, rear portion, whereby the lock core can be fully inserted into the casing. The two lugs are provided with holes accommodating fasteners for fastening the casing to an object.

8 Claims, 2 Drawing Sheets

IV
IV

REMOVABLE CORE CYLINDER LOCK

CROSS-REFERENCE TO RELATED APPLICATIONS

This application is the national phase under 35 U.S.C. § 371 of PCT International Application No. PCT/SE00/00130 which has an International filing date of Jan. 21, 2000, which designated the United States of America and was published in English.

BACKGROUND OF THE INVENTION

1. Field of the Invention

The present invention relates to a removable core cylinder lock, comprising a cylinder lock casing having a casing wall defining an axially extending cavity with an insertion opening, a removable cylinder lock core which has an outer contour corresponding to the inner contour of said cavity and which is axially insertable into the cavity through the insertion opening. The lock core has an upper, substantially massive part with a row of holes for accommodating locking tumblers, and a lower part defining a cylindrical bore extending therethrough. A cylindrical, rotatable key plug is located in the cylindrical bore and has a longitudinal key slot for receiving a key co-operating with the locking tumblers, a retainer adapted to releasably retain the lock core in an inserted position in the cavity in the lock casing, and mutually fitting parts in the rear, axially inner portions of the casing and the lock core, including projections at the rear end portion of the casing and corresponding recesses at the rear end portion of the lock core.

2. Description of Related Prior Art

Such locks are previously known from commercial embodiments offered on the market by the Best Lock Company. In these embodiments, the projection at the rear end portion of the casing comprises a pair of relatively narrow pins on a rotatable locking member, whereas the corresponding recess comprises a corresponding pair of axial bores in the key plug.

However, in such a lock, including a casing and a lock core, it is quite possible to replace a lock core of a first kind by a lock core of a second kind provided that the replacing lock core has the same or a narrower outer contour and similar axial bores in the key plug.

OBJECTS AND SUMMARY OF THE INVENTION

The object of the present invention is to further develop such a lock so as to prevent such replacement of the lock core, or at least make such replacement more difficult.

According to the present invention, this object is achieved in that the projections of the casing comprise two lugs extending radially inwards from the casing wall on each side of a central vertical plane of the casing, in that the corresponding recesses comprise two recesses located in the massive part on both sides of a central rear portion containing the row of holes, the two recesses being dimensioned to accommodate two lugs, so as to permit full insertion of the lock core into the casing, and in that the two lugs are each provided with means for fastening the casing to an object.

With such a structure, a similar lock core with exactly the same outer contour and the same length cannot be inserted into the casing unless it is provided with the same kind of recesses at its rear portion. It is a very difficult matter to measure the dimension of the lugs at the innermost end of the casing and to make a corresponding recess in the lock core.

The two lugs are separated transversely from each other so as to leave a central passage therebetween. The central rear portion of the removable core fits into this central passage.

Also, the lugs at the rear portion of the casing are used to provide means for fastening the casing to an object, such as a door or the like. Thus, the fastening means are concealed behind the lock core itself, and it will be difficult to reach the fastening means from the outside by drilling or similar operations.

The lugs and the recesses should have a substantially supplementary configuration. Preferably, each lug is defined by a concave cylindrically curved surface, whereas the lug has a corresponding convex cylindrically curved surface.

Accordingly, the structural features of the casing and the lock core will enable easy insertion of a correctly designed lock core into the casing, whereas a similar lock core, having the same outer contour, the same length but no corresponding recess of the specific kind and dimensions, cannot be inserted into the casing. Moreover, it is difficult to provide such a recess in the similar lock core by straight forward machining operations. Therefore, the removable core cylinder lock according to the invention has a high degree of security against unauthorized manipulation of the lock by replacement of the lock core with a less secure lock core of another kind.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figures 1, 2, 3, 4:
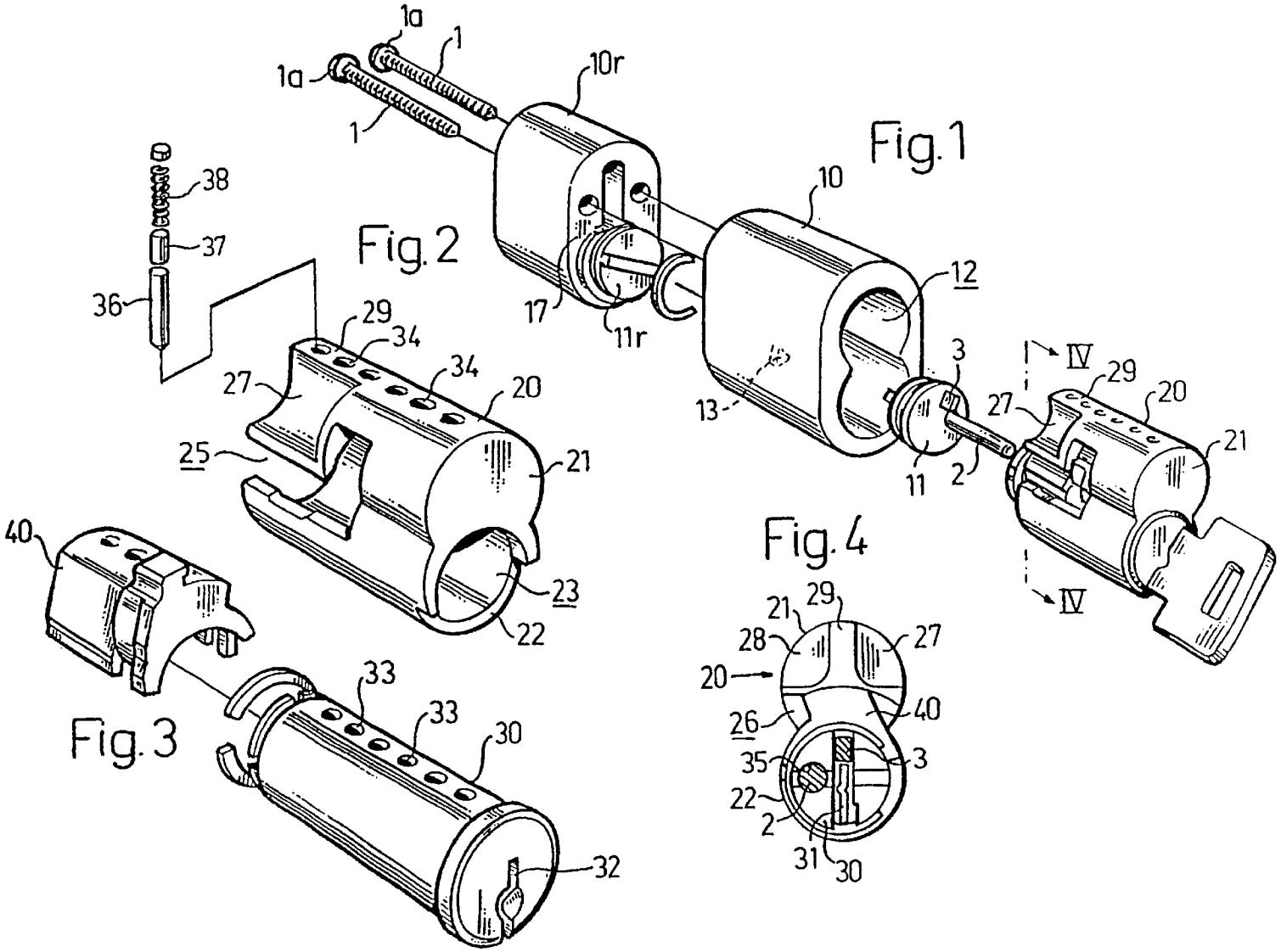
FIG. 1 shows in a perspective view a door lock assembly with two lock casings and a removable lock core to be inserted into one of the casings.
FIG. 2 shows, in perspective view, the lock core of FIG. 1 (without key plug and retainer member)
FIG. 3 shows, likewise in perspective view, a retainer member and a key plug (taken out from the lock core in FIG. 1)
FIG. 4 shows the lock core of FIG. 1 as seen from the rear end (indicated by the line IV—IV in FIG. 1)

In FIG. 1 there is shown a door lock assembly with two lock casings, viz. a rear casing **10*r* to be mounted at the inside of a door (not shown), and a front casing 10 to be mounted at the front side of the door, and a removable lock core 20 which is insertable into the casing 10. A lock core of the same kind as the lock core 20 can be inserted into the rear casing 10***r*. Alternatively, a door knob or like mechanism can be mounted in the casing 10*r* at the inside of the door. On both the rear and front sides, a rotary member 11*r* and 11, respectively, is mounted so as to transfer a rotary movement from the door knob and a key plug of the lock core 20, respectively, to a door lock mechanism (not shown) disposed between the casings 10*r* and 10.

Figure 6:
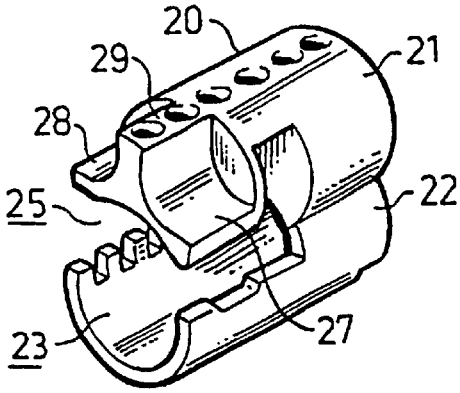
FIG. 6 shows the lock core in FIG. 1 in perspective view from the rear.

The lock core 20 shown in FIGS. 1, 2 and 6 has the general cross-sectional configuration of the digit "8" and fits with a certain play in a corresponding cavity 12 in the casing 10. The core 20 has an upper, substantially massive part 21 and a lower part 22 with an interior cylindrical bore 23 for accommodating a rotatable key plug 30 (FIG. 3). In the rear part of the lock core 20, there is a slot 25 approximately in the region between the upper and lower parts 21, 22 of the core. The slot is open at the rear end (compare FIG. 2) and extends along the core 20 somewhat longer than half the length thereof.

In this rear portion of the lock core 20, there is an adjoining chamber 26 (FIG. 4), in which there is journalled a retainer member 40 (FIG. 3). The latter is movable in the chamber 26 between a releasing position (as shown in FIG. 1) and a locking position. In the locking position, it engages with a locking projection 13 (FIGS. 1 and 5) inside the cavity 12 of the casing 10 so that it is retained in the casing and also holds the lock core 20 and the key plug 30 in inserted positions inside the cavity 12.

As is known in the art, the key plug 30 has a longitudinal key slot 31 (FIG. 4) with a front opening 32 (FIG. 3) and a row of six holes 33. The holes 33 are located in line with a row of six corresponding holes 34 in the lock core 20, when the key plug is oriented in its releasing position (as shown in FIGS. 2 and 3). In each pair of corresponding holes 33, 34, there are upper and lower tumbler pins 36, 37, which are biased downwards by helical springs 38 (FIG. 2). The tumbler pins cooperate with the upper edge of a key inserted into the key slot 31.

The door lock assembly described so far is of the general kind described in WO 96/36782 (WINLOC AG) and the Swedish patent application filed concurrently by the same applicant (WINLOC AG).

In accordance with the present invention, the casing 10 and the lock core 20 have mutually fitting projections and recesses which ensure that the lock core 20 cannot be replaced by another lock core having the same contour and length unless it is provided with exactly the same recesses.

Figure 5:
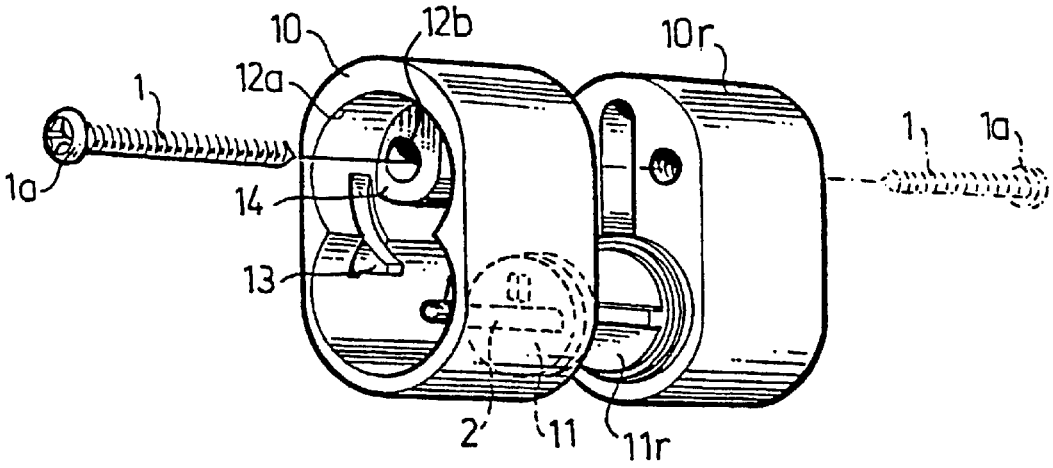
FIG. 5 shows the two casings in FIG. 1 in a perspective view from the front (from the right hand side)
Figure 7:
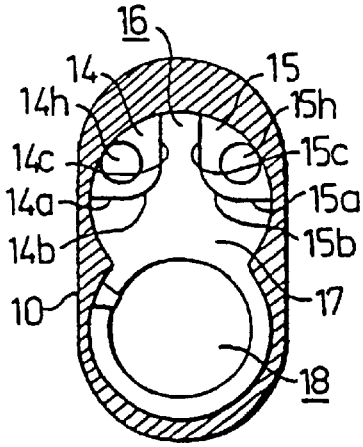
FIG. 7 is a cross-section through the casing.

As appears from FIGS. 5 and 7, the casing 10 is provided, at its rear end portion, with two lugs 14, 15, which are formed in one piece with the casing 10 and extend radially inwards from the upper cylindrical wall surface 12*a* of the cavity 12. Each lug 14, 15 is approximately triangular with a beveled or rounded edge 14*b*, 15*b* between two substantially planar, mutually perpendicular surface portions 14*a*, 14*c* and 15*a*, 15*c*, respectively. In the axial direction, the lugs 14, 15 extend from a rear end wall 17 (FIGS. 1 and 7) along a length corresponding approximately to 0.1–0.4 of the total length of the casing 10. The end wall 17 has a lower circular opening 18, in which the rotary member 11 is mounted (see also FIGS. 1 and 5).

In a cross-sectional view (FIG. 7), the length of the sides 14*a*, 14*c*, 15*a*, 15*c* of the lugs 14, 15 is about 0.2–0.4 times the diameter of the cylindrical upper portion 12*a* of the cavity, and the distance between the parallel side surfaces 14*c*, 15*c* of the lugs is therefore at least 0.2 times the last mentioned diameter. Accordingly, the lugs 14, 15 define a central passage 16 between the side surfaces 14*c*, 15*c*.

In each lug 14, 15 there is an axial hole 14*h*, 15*h* near the cavity wall 12*a*. These holes 14*h*, 15*h* serve to provide screw fasteners for fastening the casings 10, 10*r* to each other (or to some other part of the door or the like). A fastening screw 1 with a head 1*a* can be inserted from either side, i.e. from the inside of the door, as indicated in FIG. 1, or from the outside of the door (not shown), or one screw from each side, as shown in FIG. 5. The screws can engage with internal threads in the holes 14*h*, 15*h* (as shown) or with corresponding nuts (not shown). In order to make room for the screw head 1*a*, an extra recess 12*b* is formed in the cavity wall 12*a* adjacent to the respective hole 14*h*, 15*h*.

In the preferred embodiment of the invention, the lock core 20 is provided with two recesses 27, 28 at the rear end portion, as appears from FIGS. 1, 2, 4 and 6. The recesses 27, 28 are concavely curved with a curvature corresponding to the two lugs 14, 15, so as to leave a central rear portion 29 in which two of the holes 34 are located. This rear portion 29 has a length which corresponds to the axial dimension of the lugs 14, 15. Thus, the rear portion 29 can be fitted snugly into the central passage 16 of the casing 10 when the lock core 20 is inserted therein. On the other hand, any other lock core, without such recesses, cannot be inserted into the casing 10.

Of course, the exact geometrical configuration of the lugs 14, 15 and the corresponding recesses 27, 28 can be modified by those skilled in the art.

As illustrated in FIGS. 1, 4 and 5, there is a further way to prevent insertion of the lock core 20 into the casing 10, unless the lock core 20 is designed in a specific manner. The rotary member 11, which is basically cylindrical and journalled for rotation in the rear opening 18 of the casing 10, is provided with an axially extending rod 2, which is located eccentrically and is rather wide, in the specific example 3.7 to 4.5 mm. As appears from FIG. 4, the rod 2 is cylindrical (but could have any other suitable cross-sectional shape) and projects into a corresponding, somewhat wider hole 35 (4–5 mm) in the key plug 30. The hole 35 extends from the rear end surface of the key plug 30 along about half the length of the latter.

The width of the rod 2 and the corresponding hole 35 is such that the interior walls of the hole 35 are located very close to the key slot 31 and the outer circumferential surface of the key plug 30. In this way, it will be practically impossible to make such a hole in an existing lock core and key plug unit not originally designed to cooperate with the wide rod 2.

In order to secure a good transfer of the rotary movement from the key plug 30 to the rotary member 11, the latter is also provided with a short axial lug 3 which has a rectangular cross-section and fits into a corresponding groove at the rear end surface of the key plug 30.

What is claimed is:

1. Removable core cylinder lock, comprising a cylinder lock casing having a casing wall defining an axially extending cavity with an insertion opening, a removable cylinder lock core which has an outer contour corresponding to the inner contour of said cavity and which is axially insertable into said cavity through said insertion opening, said lock core having an upper, substantially massive part with a row of holes for accommodating locking tumblers, and a lower part defining a cylindrical bore extending there-through, a cylindrical, rotatable key plug located in said cylindrical bore and having a longitudinal key slot for receiving a key co-operating with said locking tumblers, retaining means adapted to releasably retain said lock core in an inserted position in said cavity in said lock casing, and mutually fitting parts in the rear, axially inner portions of said casing and said lock core, including projections at the rear end portion of the casing and corresponding recesses at the rear end portion of the lock core, the lock characterized in that:

said projections of the casing comprise two lugs extending radially inwards from the casing wall on each side of a central vertical plane of the casing, said corresponding recesses comprise two recesses located in said massive part on both sides of a central rear portion containing said row of holes, said two recesses being dimensioned to accommodate said two lugs so as to permit full insertion of said lock core into said casing, and said two lugs each being provided with means for fastening said casing to an object.

2. A lock as defined in claim 1, wherein said fastening means comprises an axial hole in each lug.

3. A lock as defined in claim 2, wherein at least one of said axial holes is threaded so as to cooperate with a threaded fastening screw.

4. A lock as defined in claim 2, wherein at least one of the axial holes is a free hole adapted to receive a fastening screw, said lock core having an extra recess adapted to receive a head on a fastening screw head.

5. A lock as defined in claim 1, wherein each recess is defined by a concave cylindrically curved surface, each lug having a corresponding convex cylindrically curved surface.

6. A lock as defined in claim 2, wherein each recess is defined by a concave cylindrically curved surface, each lug having a corresponding convex cylindrically curved surface.

7. A lock as defined in claim 3, wherein each recess is defined by a concave cylindrically curved surface, each lug having a corresponding convex cylindrically curved surface.

8. A lock as defined in claim 4, wherein each recess is defined by a concave cylindrically curved surface, each lug having a corresponding convex cylindrically curved surface.

* * * * *

UNITED STATES PATENT AND TRADEMARK OFFICE

CERTIFICATE OF CORRECTION

PATENT NO. : 6,606,890 B1
DATED : August 19, 2003
INVENTOR(S) : Bo Widen

It is certified that error appears in the above-identified patent and that said Letters Patent is hereby corrected as shown below:

Title page,
Add the following information:

Item -- [30] Foreign Application Priority Data

Jan. 22, 1999 (SW)……..9900193-5 --

Signed and Sealed this

Thirteenth Day of April, 2004

JON W. DUDAS
*Acting Director of the United States Patent and Trademark Office*